United States Patent [19]

Richter

[11] Patent Number: 5,027,620

[45] Date of Patent: Jul. 2, 1991

[54] DIFFUSER WITH FLEXIBLE BELLOWS AND INTERNAL ACTUATOR

[75] Inventor: Ole J. Richter, Karlstad, Sweden

[73] Assignee: Kamyr AB, Karlstad, Sweden

[21] Appl. No.: 488,722

[22] Filed: Feb. 26, 1990

[51] Int. Cl.[5] ..... D21D 5/04

[52] U.S. Cl. ..... 68/181 R; 8/156; 210/333.01; 162/60; 162/251

[58] Field of Search ..... 68/181 R; 8/156; 210/333.01; 162/60, 251

[56] References Cited

U.S. PATENT DOCUMENTS

| | | | |
|---|---|---|---|
| 3,622,262 | 11/1971 | Leffler | 162/60 |
| 4,041,560 | 8/1977 | Jacobsen | 8/156 |
| 4,375,410 | 3/1983 | Richter et al. | 162/251 |
| 4,441,224 | 4/1984 | Laakso | 162/60 |
| 4,521,315 | 6/1985 | Laakso | 68/181 R |
| 4,525,275 | 6/1985 | Ostlund | 210/333.01 |
| 4,556,494 | 12/1985 | Richter et al. | 162/60 |
| 4,793,161 | 12/1988 | Richter et al. | 68/181 R |
| 4,881,286 | 11/1989 | Richter et al. | 68/181 R |

*Primary Examiner*—William A. Cuchlinski, Jr.
*Assistant Examiner*—G. Bradley Bennett
*Attorney, Agent, or Firm*—Cushman, Darby & Cushman

[57] ABSTRACT

In a paper pulp treating vessel, such as a pulp thickener or diffuser, the screens are backflushed by reciprocating an internal piston utilizing an internally mounted hydraulic cylinder. The screens are supported by conduit arms having a central hub, and the hydraulic cylinder is mounted directly on top of the hub, with the backflushing cylinder mounted below the hub. Hydraulic lines lead from exteriorly of the vessel to the hydraulic cylinder within the vessel, and a sealing conduit is mounted surrounding the hydraulic lines. The sealing conduit extends to a point above the top of the vessel to act as an indicator if hydraulic fluid leaks in the vessel. A flexible bellows is connected between the sealing conduit and the hydraulic cylinder to allow tilting action between the arms and the top of the vessel.

20 Claims, 2 Drawing Sheets

DIFFUSER WITH FLEXIBLE BELLOWS AND INTERNAL ACTUATOR

BACKGROUND AND SUMMARY OF THE INVENTION

A pulp treating vessel, such as a diffuser or a thickener, is shown in U.S. Pat. Nos. 4,793,161 and 4,881,286, which effectively backflushes screens within the vessel in an efficient manner to unclog the screens, without surge in the vessel volume. While the structure illustrated in said patents effectively performs the desired function, there are several possible minor drawbacks associated therewith. For example, the extraction arms may sag slightly due to the provision of an external actuator for the internal backflushing cylinder, and operation of the backflushing cylinder can be adversely affected if there is a tilting action between the internal screens and the top of the vessel.

According to the present invention, the potential minor problems discussed above are eliminated in a simple and effective manner that allows all the desirable results achieved by the structures of said U.S. Pat. Nos. 4,793,161 and 4,881,286 to be accomplished.

The pulp treating apparatus according to the invention comprises the conventional elements, in common with the structures illustrated in said patents, of a vessel, pulp inlet, pulp outlet, screen and supporting liquid conduits, extraction means, and an internal screen backflushing piston and cylinder. The invention differs from the prior constructions by providing the means for effecting actuation of the backflushing piston within the vessel. Preferably the actuator means comprises a second cylinder mounted on top of the arms that define the supporting liquid conduits for the screens, at a hub section thereof. The backflushing cylinder is mounted to the bottom of the arms at the hub, and a piston rod extends between the pistons associated with the cylinders. Hydraulic fluid is supplied to the actuating cylinder by fluid lines extending from the exterior of the vessel through a sealing conduit. The sealing conduit extends to a position above the top of the vessel so that should there be any hydraulic fluid leakage into the sealing conduit it will be indicated exteriorly of the vessel. A flexible bellows comprises part of the sealing conduit, preferably that portion attached directly to the hydraulic cylinder, to allow tilting action of the arms with respect to the top of the vessel.

The vessel is particularly adapted for pulp thickening, diffusion washing, and displacement bleaching, but may be utilized in other treatment systems which utilize screens that must be backflushed.

It is the primary object of the present invention to provide for efficient, reliable, and effective long term backflushing of screens in a pulp treatment vessel. This and other objects of the invention will become clear from an inspection of the detailed description of the invention and from the appended claims.

DETAILED DESCRIPTION OF THE DRAWINGS

Figure 1:
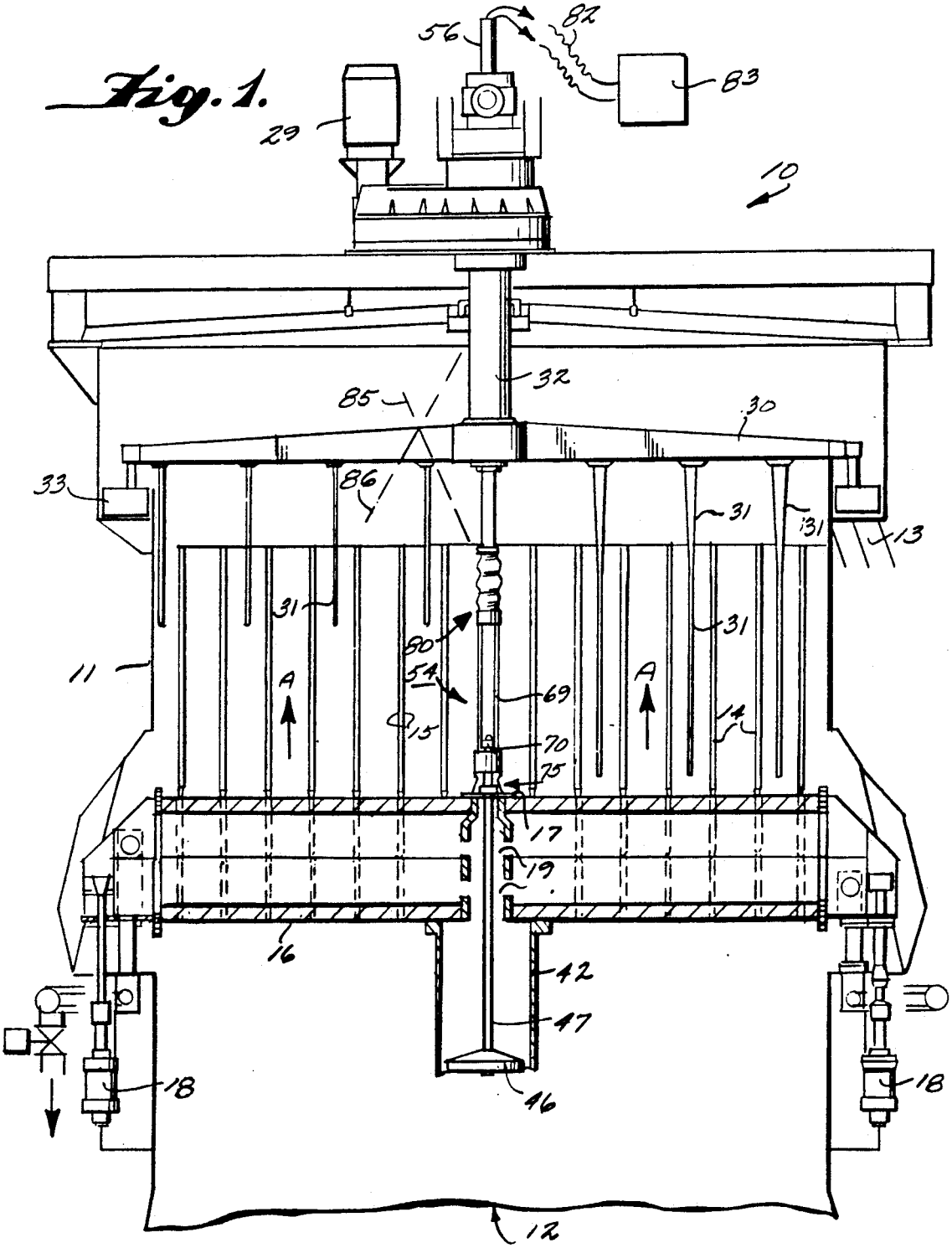
FIG. 1 is a side view, partly in cross-section and partly in elevation, of an exemplary diffusion washer according to the present invention.

FIG. 1 illustrates a diffusion washer which is used for washing paper pulp, and effects backflushing of the screens to keep them unclogged. This apparatus, indicated generally by reference numeral 10, includes a generally upright vessel 11 having a pulp inlet 12 and a pulp outlet 13 which are vertically spaced from each other. The pulp is introduced into the pulp inlet 12, which typically is at the bottom, and flows vertically within the vessel 11, being discharged through the conduit 13 adjacent the top. The basic operative components of the device 10 comprise a plurality of concentric cylindrical screens 14, having screen faces 15 which are generally vertical and are in contact with the pulp. The concentric screens 14 are supported on support conduits 16, which typically are in the shape of arms extending radially outwardly from a central hub section 17. The conduits 16 are hollow, and the interior may be divided into chambers if desirable. Header openings 19 interior of the arms 16 distribute backflushing fluid.

The screen arms 16 are mounted for reciprocation in the vertical directions by a reciprocating power structure or structures, preferably three or more hydraulic cylinders 18 which are equally spaced around the periphery of the device 10. The cylinders 18 reciprocate the screens 14 and support arms 16 so that they move very slowly in the direction of pulp movement (arrows A in FIG. 1) until the end of the vertical stroke is reached, and then reverse and move opposite to the direction A. While the relative speeds in direction A and opposite to direction A can be varied, in many installations the movement in direction A is much slower than the movement in the direction opposite to A (i.e. downwardly in the exemplary embodiment illustrated). This serves to assist in keeping the screens 14 relatively clog-free.

What has just been described above is utilizable for thickening operations. Where the pulp is to be treated with a liquid, too, such as a wash liquid or a bleaching liquid, then the rotating arms 30 with depending vertical spray nozzles 31 and scrapers 33 are utilized, the arms 30 being provided with treatment liquid through the hollow shaft 32. Shaft The scrapers 33 are mounted to the rotating arms 30 at the top of the vessel 11 for scraping treatment fluid into the pulp outlet 13 from adjacent the top of the vessel 11. The scrapers 33 are powered by the rotation of the arms 30 by the hollow shaft 32. 32 is rotated while supplying wash or bleaching liquid, or the like, by a motor 29.

The backflushing device for the apparatus 10 is preferably as illustrated in U.S. Pat. No. 4,793,161 (the disclosure of which is hereby incorporated by reference herein). It includes a simple cylinder 42 which is connected to the bottom of the arms 16 at the central hub 17 thereof, and is open at both ends. The first end open to the interior of the arms 16, and the end is open to the volume of the pulp within the 11. Mounted within the cylinder 42 for relative reciprocation with respect to the cylinder is a piston 46. Means are provided for effecting relative movement between the piston 46 and the cylinder 42, which means includes the piston rod 47 to the piston 46. Reciprocation of the rod 47 is provided by a second piston and cylinder assembly, namely a hydraulic cylinder 54, mounted internally of the vessel 11 and preferably to the arms 16 at the central hub section 17 thereof extending upwardly from the top of the 16 while the cylinder 42 extends downwardly from the bottom thereof and the piston rod 47 extend through the conduit arms 16.

Hydraulic fluid is provided to the hydraulic cylinder 54 by hydraulic fluid lines passing through the top of the vessel 11 through a split pack box 55 connected to the of the hollow shaft 32, and through the sealing conduit 56. Preferably three hydraulic fluid lines, which are typical flexible high pressure oil hoses, 57, 58, and 59, are provided. The sealing conduit 56 preferably includes a rigid portion at a split pack box 55, which extends upwardly past the top of the vessel 11. This thus provides an indication (either visual, if transparent or windowed, or sensed by a conventional sensor) hydraulic fluid leaks, so that the leak can be detected before the oil has a chance to leak past the sealing conduit 56 into the pulp. The hydraulic lines 57, 58 and 59 and the sealing conduit 56 pass through the center of hollow shaft 32 and are sealed thereto by the split pack box 55.

The hydraulic lines are connected to a top ring 60 at the top of the hydraulic cylinder 54, the conduit 57 leading through opening 61 to the interior of the hydraulic cylinder 54 at one end thereof, while the line 62—connected to the line 58 from the ring 60—extends to the opposite end of the hydraulic cylinder 54. A bottom ring 64 is provided at the bottom of the hydraulic cylinder 54, and a hydraulic line 65 leads from the line 59 to the oil seal 66.

The hydraulic cylinder 54 includes an actual cylinder 69 which has a piston 70 therein, with a first face 71 selectively exposed to the high pressure from line 57, and a second face 72 selectively exposed to the high pressure from line 58.

The hydraulic cylinder 54 is preferably mounted to the top of the arms 16 at the hub 17 by a pedestal bracket 75. The bracket 75 has openings 76 that allow the flow of pulp therethrough. Within the pedestal bracket 75 is a seal 77 which seals the piston rod 47 so that there is not a significant amount of leakage from the interior of the vessel to the interior of the arms 16, and vice-versa.

Figure 2:
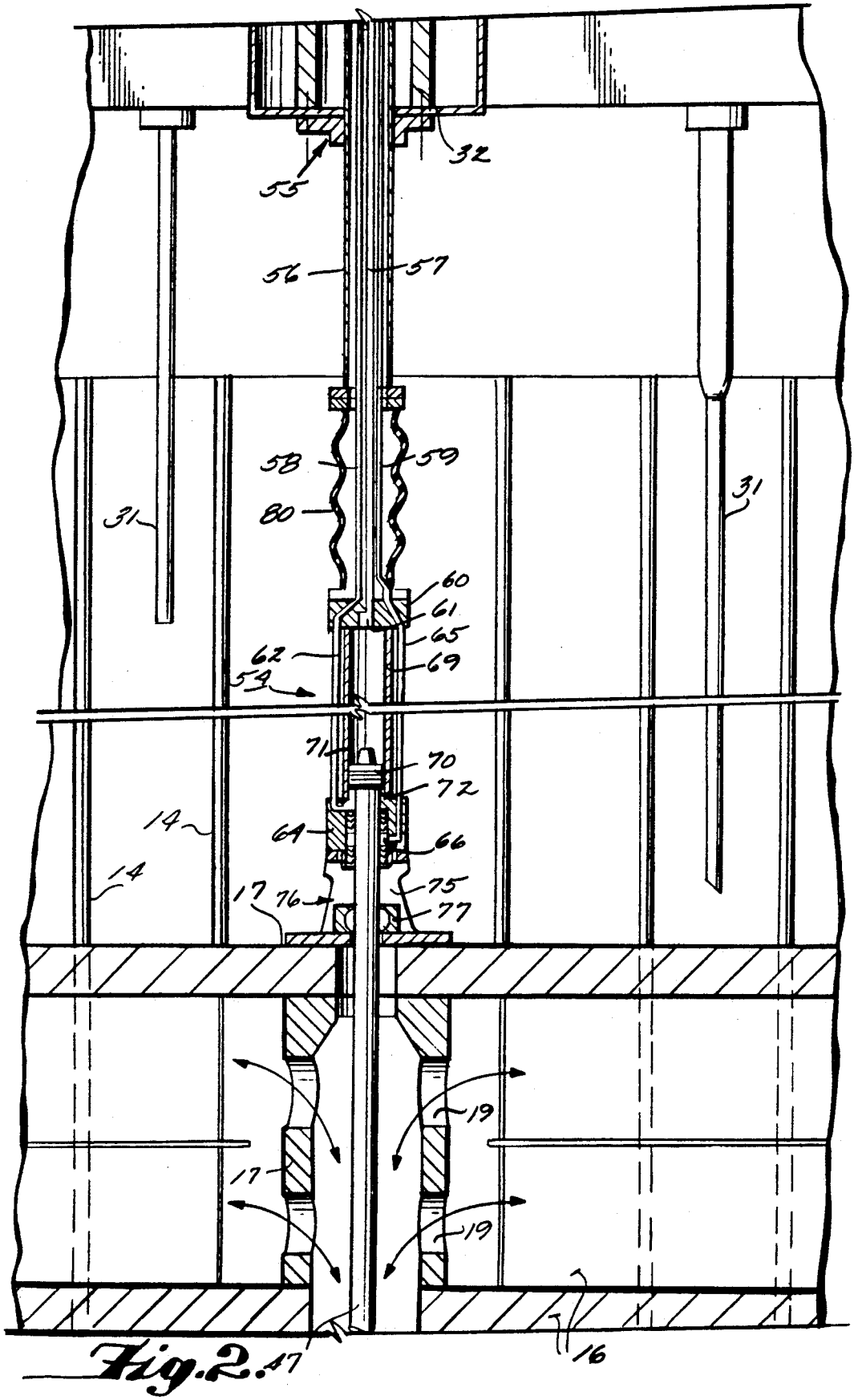
FIG. 2 is a detail cross-sectional view showing the hydraulic actuator, and related components, of the apparatus of FIG. 1.

Part of the sealing conduit 56 preferably comprises the flexible bellows 80. For example the bellows 80 may be attached to the ring 60 and the bottom of the rigid portion of the sealing conduit 56, as illustrated most clearly in FIG. 2. The flexible bellows 80 allows tilting movement between the arms 16 and the top of the vessel without interfering with actuation of the backflushing cylinder.

At the top of the vessel 11 the flexible hoses 82 extend from the interior of the conduit 56 to a conventional hydraulic unit 83. The hydraulic unit provides selective application of hydraulic fluid to lines 57 and 58 to provide for reciprocation of the piston 70 in either direction desired.

It will thus be seen that according to the present invention an internal actuator (54) for the backflushing cylinder 46 is provided, with a flexible mount (80) between the top of the vessel and the actuating cylinder. The actuator is not seen, there will be no sag or adverse effect on backflushing due to tilting of component parts, and there is no surge in the vessel. While the invention has been shown herein and described in what is presently conceived to be the most practical and preferred embodiment, it will be apparent to those of ordinary skill in the art that many modifications may be made thereof within the scope of the invention which scope is to be accorded the broadest interpretation of the appended claims so as to encompass all equivalent structures and devices.

What is claimed is:

1. A pulp treating apparatus comprising:

a generally upright vessel defining an interior volume containing pulp to be treated; a pulp inlet to the vessel; a pulp outlet from the vessel, the pulp flowing generally vertically between the inlet and the outlet; a plurality of screens mounted within the vessel and connected to supporting liquid conduits; extraction means for withdrawing liquid from the pulp, through the screens, and through the conduits to a point outside the vessel; screen backflushing means mounted within the vessel and including a first, open-ended, cylinder having first and second ends, the first end in open communication with liquid in the liquid conduits, and the second end in open communication with the pulp within the interior volume of the vessel; a first piston mounted within the first cylinder; and means for effecting relative movement between said first piston and first cylinder to cause the first piston to force liquid out of the first cylinder in one direction of relative movement therebetween, to effect backflushing, and to take liquid into the cylinder in another direction of relative movement therebetween; and said means for effecting relative movement between said first piston and said cylinder comprising a piston rod having first and second ends, and attached at the first end thereof to said first piston, and attached at the second end thereof to a second piston; said second piston disposed within a second cylinder; and means for supplying high pressure actuating fluid to said second cylinder for powering actuation of said second piston; and second piston and second cylinder and piston rod mounted completely within said vessel.

2. Apparatus as recited in claim 1 comprising a diffusion washer, and including moving spray tubes for introducing wash liquid between said screens.

3. Apparatus as recited in claim 1 comprising a displacement bleacher, and including spray tubes for introducing bleaching fluid between said screens.

4. Apparatus as recited in claim 1 further comprising means for effecting vertical movement of said screens and supporting conduits in the direction of pulp movement at a first speed, and in the direction opposite to pulp movement at a second speed much faster than said first speed.

5. Apparatus as recited in claim 2 further comprising a scraper mounted at the top of said vessel for scraping treatment fluid into said pulp outlet from adjacent the top of said vessel, said scraper powered by rotation of a scraper shaft; and wherein said scraper shaft is hollow and is disposed in the center of said vessel, and wherein said hydraulic lines and sealing conduit pass through the center of said hollow shaft and are sealed thereto by a split pack box.

6. Apparatus as recited in claim 1 wherein said extraction means comprises a plurality of radially extending arms, extending outwardly from a central hub; and wherein said second cylinder is mounted directly on top of said arms at said hub and said first cylinder is mounted to said arms extending downwardly from said hub, with said piston rod passing through the center of said hub.

7. Apparatus as recited in claim 6 further comprising a flexible bellows attached to said second cylinder and extending upwardly therefrom.

8. Apparatus as recited in claim 6 comprising a diffusion washer, and including moving spray tubes for introducing wash liquid between said screens.

9. Apparatus as recited in claim 6 comprising a displacement bleacher, and including spray tubes for introducing bleaching fluid between said screens.

10. Apparatus as recited in claim 1 wherein said means for supplying actuating fluid to said second cylinder comprises flexible hydraulic fluid lines extending from exteriorly of said vessel to said second cylinder; and a sealing conduit disposed around said hydraulic lines to prevent leakage into the pulp should there be a break in a hydraulic line.

11. Apparatus as recited in claim 2 wherein said sealing conduit comprises indicator means extending exteriorly of said vessel from the interior thereof, to indicate if there has been leakage of hydraulic fluid.

12. Apparatus as recited in claim 3 further comprising a flexible bellows forming part of said sealing conduit so as to allow tilting action between said sealing conduit and internal components of the vessel connected to said second cylinder.

13. Apparatus as recited in claim 4 wherein said supporting liquid conduits comprise a plurality of radially extending arms, extending outwardly from a central hub; and wherein said second cylinder is mounted directly on top of said arms at said hub and said first cylinder is mounted to said arms extending downwardly from said hub, with said piston rod passing through the center of said hub.

14. Apparatus as recited in claim 5 wherein said second cylinder is mounted to said hub by a pedestal which allows the circulation of pulp therethrough past said piston rod; and further comprising sealing means surrounding said piston rod at the top of said hub.

15. Apparatus as recited in claim 5 further comprising a scraper mounted at the top of said vessel for scraping treatment fluid into said pulp outlet from adjacent the top of said vessel, said scraper powered by rotation of a scraper shaft; and wherein said scraper shaft is hollow and is disposed in the center of said vessel, and wherein said hydraulic lines and sealing conduit pass through the center of said hollow shaft and are sealed thereto by a split pack box.

16. A pulp treating vessel including, disposed therein:

a plurality of concentric screens;

conduits in the form of arms radially extending from a hub for mounting said screens thereon extending upwardly therefrom, said conduits in operative association with the interior of said screens;

backflushing means comprising a first cylinder, open at both ends thereof, mounted to said hub extending downwardly therefrom, and a first piston mounted in said first cylinder, said first cylinder at one end thereof open to the interior of said arms, and at the other end thereof to said vessel; and an actuating means for actuating said first piston, said actuating means comprising a second cylinder mounted on said hub and extending upwardly therefrom, a second piston in said second cylinder, and a piston rod connecting said second piston to said first piston, said piston rod extending through said hub past the top and the bottom thereof.

17. Apparatus as recited in claim 16 wherein said second cylinder is mounted to said hub by a pedestal which allows the circulation of pulp therethrough past said piston rod; and further comprising sealing means surrounding said piston rod at the top of said hub.

18. Apparatus as recited in claim 16 further comprising flexible hydraulic fluid lines extending from exteriorly of said vessel to said second cylinder; and a sealing conduit disposed around said hydraulic lines to prevent leakage into the pulp should there be a break in a hydraulic line.

19. Apparatus as recited in claim 17 further comprising a flexible bellows forming part of said sealing conduit so as to allow tilting action between said sealing conduit and internal components of the vessel connected to said second cylinder.

20. Apparatus as recited in claim 18 wherein said sealing conduit comprises indicator means extending exteriorly of said vessel from the interior thereof, to indicate if there has been leakage of hydraulic fluid.

* * * * *

UNITED STATES PATENT AND TRADEMARK OFFICE
CERTIFICATE OF CORRECTION

PATENT NO. : 5,027,620

DATED : July 2, 1991

INVENTOR(S) : RICHTER

It is certified that error appears in the above-identified patent and that said Letters Patent is hereby corrected as shown below:

Column 2, line 45, delete "Shaft" (second occurence);

line 50, after "32" (second occurence) insert --Shaft--;

line 58, after "and the" insert --second--;

line 59, after "within the" insert --vessel--;

line 63, after "47" insert --connected--;

line 64, after "of the" insert --piston--.

Column 3, line 1, after "the" (first occurence) insert --arms--;

line 2, change "extend" to --extends--;

line 7, after "the" (first occurence) insert --bottom--;

line 14, after "sensor)" insert --of when--.

UNITED STATES PATENT AND TRADEMARK OFFICE

CERTIFICATE OF CORRECTION

PATENT NO. : 5,027,620

DATED : July 2, 1991

INVENTOR(S) : RICHTER

It is certified that error appears in the above-identified patent and that said Letters Patent is hereby corrected as shown below:

IN THE CLAIMS:

Column 4;
Claim 5, line 1, change "2" to --10--.

Column 5;
Claim 11, line 1, change "2" to --10--.

Claim 12, line 1, change "3" to --11--.

Claim 13, line 1, change "4" to --12--.

Claim 14, line 1, change "5" to --13--.

Claim 15, line 1, change "5" to --13--.

Column 6;
Claim 19, line 1, change "17" to --18--.

Claim 20, line 1, change "18" to --19--.

Signed and Sealed this

Ninth Day of February, 1993

*Attest:*

STEPHEN G. KUNIN

*Attesting Officer*

*Acting Commissioner of Patents and Trademarks*